US009080571B2

(12) United States Patent
Downham et al.

(10) Patent No.: US 9,080,571 B2
(45) Date of Patent: Jul. 14, 2015

(54) PUMP ENVELOPED WITH THERMALLY CONDUCTIVE MATERIAL

(75) Inventors: Stephen Edward Downham, Worthing (GB); David Paul Manson, New Haven (GB); Huw David Powell, Shoreham-by-Sea (GB)

(73) Assignee: Edwards Limited, Crawley, West Sussex (GB)

( * ) Notice: Subject to any disclaimer, the term of this patent is extended or adjusted under 35 U.S.C. 154(b) by 0 days.

(21) Appl. No.: 13/979,779

(22) PCT Filed: Jan. 17, 2012

(86) PCT No.: PCT/GB2012/050090

§ 371 (c)(1),
(2), (4) Date: Jul. 15, 2013

(87) PCT Pub. No.: WO2012/098386

PCT Pub. Date: Jul. 26, 2012

(65) Prior Publication Data

US 2013/0294957 A1 Nov. 7, 2013

(30) Foreign Application Priority Data

Jan. 19, 2011 (GB) ..... 1100849.7

(51) Int. Cl.
*F01C 21/00* (2006.01)
*F03C 2/00* (2006.01)
(Continued)

(52) U.S. Cl.
CPC ..... *F04C 29/04* (2013.01); *F01C 21/10* (2013.01); *F04C 18/126* (2013.01); *F04C 18/16* (2013.01); *F04C 25/02* (2013.01); *F04C 2220/30* (2013.01); *F04C 2230/21* (2013.01); *F04C 2280/04* (2013.01); *F05C 2251/00* (2013.01); *F05C 2251/048* (2013.01); *Y10T 29/49245* (2015.01)

(58) Field of Classification Search
USPC ..... 418/201.1, 206.5, 178–179, 1, 9, 83, 85
See application file for complete search history.

(56) References Cited

U.S. PATENT DOCUMENTS 3,937,266 A 2/1976 Cordone et al.
4,099,994 A * 7/1978 Ikawa et al. ..... 148/614
(Continued)

FOREIGN PATENT DOCUMENTS

JP 2009144683 A 7/2009
WO 2007088103 A1 8/2007

OTHER PUBLICATIONS

International Search Report dated May 31, 2013 for corresponding International Application No. PCT/GB2012/050090, filed Jan. 17, 2012.

(Continued)

*Primary Examiner* — Theresa Trieu
(74) *Attorney, Agent, or Firm* — Westman, Champlin & Koehler, P.A.

(57) ABSTRACT

A pump comprises a rotor arrangement and a stator arrangement. The stator arrangement comprises a first part made from a corrosive resistant material which defines a volume which in use is swept by the rotor arrangement for pumping fluid from an inlet to an outlet of the stator arrangement. A second part of the stator arrangement is made from a thermally conductive material which envelopes the first part so that heat generated in the first part can be transferred to the second part at the interface surface between the two parts. The second part has formed therein at least one duct for conveying a liquid coolant through the second part so that heat can be transferred from the second part to the liquid coolant for cooling the stator arrangement.

7 Claims, 4 Drawing Sheets

(51) Int. Cl.

| | |
|---|---|
| ***F03C 4/00*** | (2006.01) |
| ***F04C 29/04*** | (2006.01) |
| ***F01C 21/10*** | (2006.01) |
| ***F04C 18/12*** | (2006.01) |
| ***F04C 18/16*** | (2006.01) |
| ***F04C 25/02*** | (2006.01) |

(56) References Cited

U.S. PATENT DOCUMENTS

| | | | | | |
|---|---|---|---|---|---|
| 4,464,101 | A | | 8/1984 | Shibuya | |
| 4,789,314 | A | * | 12/1988 | Higuchi et al. | 418/9 |
| 6,530,762 | B2 | * | 3/2003 | Houze et al. | 418/179 |
| 7,118,350 | B2 | * | 10/2006 | Graf et al. | 417/206 |
| 2001/0028858 | A1 | | 10/2001 | Houze et al. | |
| 2006/0127245 | A1 | | 6/2006 | Ohmi et al. | |

OTHER PUBLICATIONS

International Written Opinion of the International Searching Authority dated May 31, 2013 for corresponding International Application No. PCT/GB2012/050090, filed Jan. 17, 2012.

United Kingdom Search Report dated May 19, 2011 of Application No. GB1100849.7 Jan. 19, 2011.

* cited by examiner

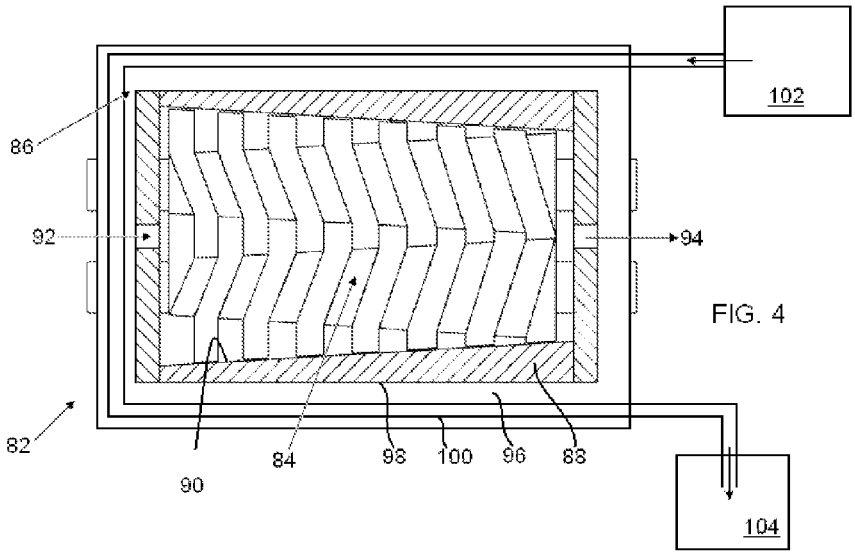
FIG. 4
FIG. 5
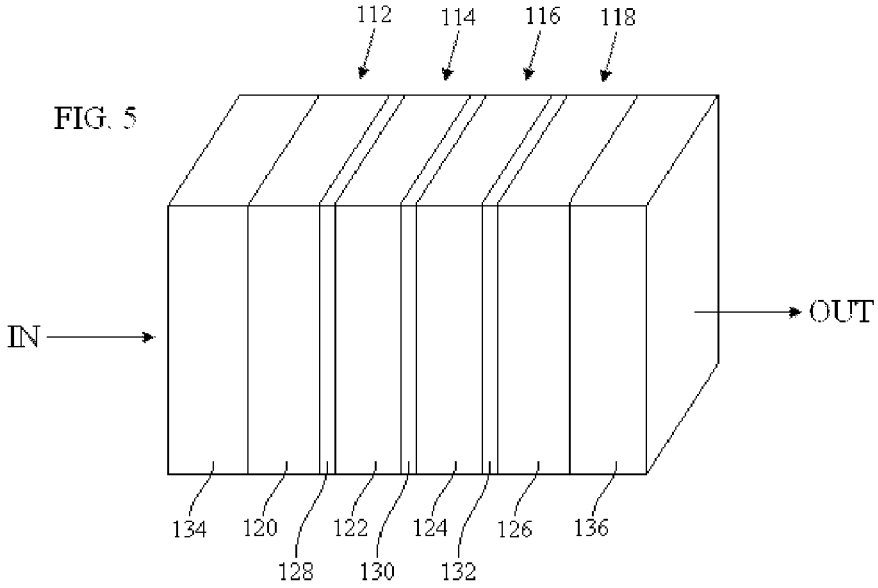

PUMP ENVELOPED WITH THERMALLY CONDUCTIVE MATERIAL

CROSS-REFERENCE TO RELATED APPLICATION

This Application is a Section 371 National Stage Application of International Application No. PCT/GB2012/050090, filed Jan. 17, 2012, which is incorporated by reference in its entirety and published as WO 2012/098386 on Jul. 26, 2012 and which claims priority to British Patent Application No. 1100849.7 filed on Jan. 19, 2011.

BACKGROUND

The invention relates to a vacuum pump and a stator arrangement for a vacuum pump.

A vacuum pump may be formed by positive displacement pumps such as roots, claw or screw pumps. These pumps comprise a stator arrangement which defines a volume which is swept by a rotor arrangement for pumping gas from an inlet to an outlet of the stator arrangement. Heat is generated by the compression of the pumped gas and by inefficiencies in the mechanical and electrical components, when in use.

The generation of heat in vacuum pumps can decrease reliability and performance. For example, vacuum pumps may seize due to the deposition of metal based semiconductor precursors, which increases at higher temperatures and causes the reduction of clearances between the stator and rotor components. Corrosion, due to the reaction of gases such as fluorine with the surfaces of pump components, also causes a reduction in clearances at higher temperatures. It has also been noted that pump lubricant may be degraded or evaporated.

Typically, pumps are cooled by cooling plate assemblies or water jackets. In the former, aluminium cooling plates are secured to a surface of a pump stator. Tubes are pressed into the surface of the plates for conveying a liquid coolant, which is usually water. Heat is transferred to the water across three thermal interfaces. The first interface is that of the pump stator to the aluminium plates. The second interface is from the plates to the tubes, and the final interface is from the tubes to the water. Heat in the water is then carried away from the system. Although this method of cooling has been optimised over time it is still not a particularly efficient way of cooling. The amount of surface area over which the cooling plate assemblies can be applied limits the magnitude of heat that can be removed. It may also be possible to secure a cooling plate to only one of the surfaces of the stator or at least not all of the surfaces of the stator because of other components which may require attachment to the pump and block access for cooling.

In water jackets, the pump stator is hollow and water is conveyed through it removing the heat from the system. This method is thermally more efficient than the cooling plate assembly approach but practical drawbacks exist. The water jacket method of cooling is usually implemented in one of two ways; directly or indirectly. Direct cooling involves passing water directly through the core of the pump stator and thus corrosion becomes a concern since many pumps are constructed from iron. Indirect cooling means that the cooling water is provided by a closed system running with water conditioned with corrosion inhibitors. Such a system is complicated and expensive since a pump is required to circulate the water and a heat exchanger is required to cool the cooling water.

The discussion above is merely provided for general background information and is not intended to be used as an aid in determining the scope of the claimed subject matter. The claimed subject matter is not limited to implementations that solve any or all disadvantages noted in the background.

SUMMARY

Embodiments herein provide an improved vacuum pump having a stator arrangement configured for allowing efficient cooling.

A first aspect provides a vacuum pump comprising a rotor arrangement and a stator arrangement, the stator arrangement comprising a first part made from a corrosive resistant material defining a volume which in use is swept by the rotor arrangement for pumping fluid from an inlet to an outlet of the stator arrangement, and a second part made from a thermally conductive material which envelopes the first part so that heat generated in the first part can be transferred to the second part at the interface surface between the two parts, the second part having formed therein at least one duct for conveying a liquid coolant through the second part so that heat can be transferred from the second part to the liquid coolant for cooling the stator arrangement. Alternatively, there is provided a vacuum pump stator comprising a first part made from a corrosive resistant material defining a volume which in use is swept by a rotor arrangement for pumping fluid from an inlet to an outlet of the stator, and a second part made from a thermally conductive material which envelopes the first part so that heat generated in the first part can be transferred to the second part at the interface surface between the two parts, the second part having formed therein at least one duct for conveying a liquid coolant through the second part so that heat can be transferred from the second part to the liquid coolant for cooling the stator. The second part of the stator can be formed by casting it around the first part of the stator.

A second aspect provides a stator slice, comprising a first part formed from a corrosion resistant material defining a volume which, in use, is swept by a rotor arrangement for pumping fluid from an inlet to an outlet of the stator slice; and a second part made from a thermally conductive material which envelopes the first part so that heat generated in the first part, in use, can be transferred to the second part at the interface surface between the two parts, the second part having formed therein at least one duct for conveying a liquid coolant through the second part, in use, so that heat can be transferred from the second part to the liquid coolant for cooling the stator slice.

A third aspect also provides a stator arrangement comprising a plurality of stator slices forming a laminated pump structure, at least one of said stator slices comprising a first part made from a corrosive resistant material defining a volume which in use is swept by a rotor arrangement for pumping fluid from an inlet to an outlet of the stator arrangement, and a second part made from a thermally conductive material which envelopes the first part so that heat generated in the first part can be transferred to the second part at the interface surface between the two parts, the second part having formed therein at least one duct for conveying a liquid coolant through the second part so that heat can be transferred from the second part to the liquid coolant for cooling the stator arrangement.

A fourth aspect provides a method of manufacturing a stator slice for a stator arrangement for a laminated pump structure comprising the steps of: forming a first part made from a corrosive resistant material comprising an inlet and outlet and defining a volume which, in use, is swept by a rotor arrangement for pumping fluid from an inlet to an outlet of the stator slice; casting a second part, made from a thermally conductive material, around said first part to envelope the first part and form an intimate interface surface between the first and second parts so that, in use, heat generated in the first part can be transferred to the second part at the interface surface between the two parts; and forming at least one duct in the second part for conveying a liquid coolant through the second part so that, in use, heat can be transferred from the second stator to the liquid coolant for cooling the stator slice.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order that the invention may be well understood, some embodiments thereof, which are given by way of example only, will now be described with reference to the drawings in which:

FIG. 4 is a cross section of a screw pump; and

FIG. 5 is a schematic representation of laminated pump.

DETAILED DESCRIPTION

Figure 1:
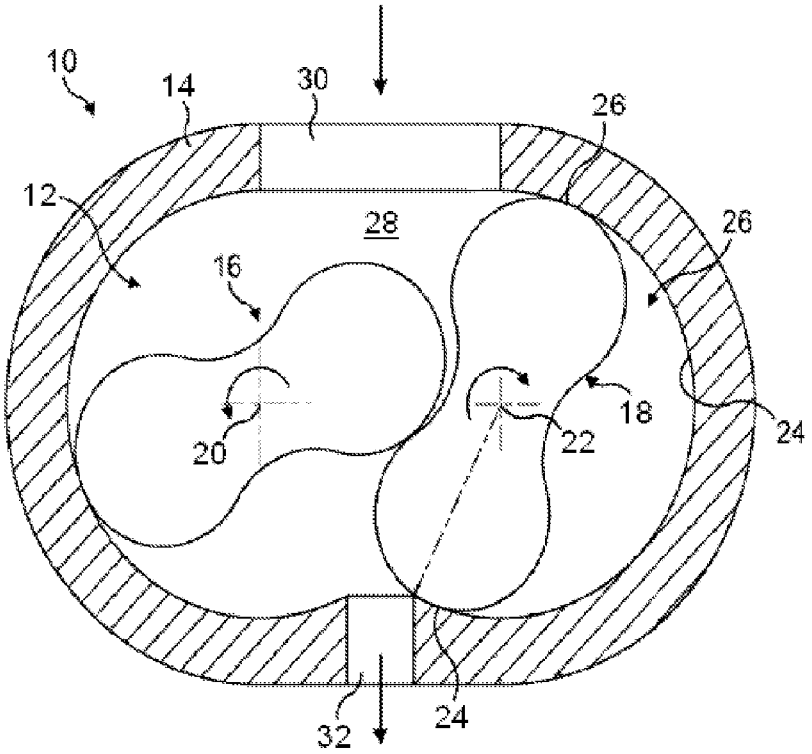
FIG. 1 PRIOR ART
FIG. 1 is a cross section of a prior art Roots pump.

FIG. 1 shows a cross section of a Roots pump 10 known in the art and described in WO2007/088103. The pump comprises a pumping, or swept, volume 12 defined by a stator body 14. A rotor arrangement comprising a pair of contra-rotating intermeshing multi-lobed rotors 16, 18 are arranged to rotate about respective horizontal axes 20 and 22. The pump in FIG. 1 has two lobes on each rotor and tip portions 24 and 26 of the lobes are arranged to cooperate with an arcuate inner surface 24 of the stator, thereby trapping a volume of gas 28 between the rotor and stator 14. Gas is pumped from an inlet 30 to an outlet 32 by the counter rotational movement of the rotors.

Figure 2:
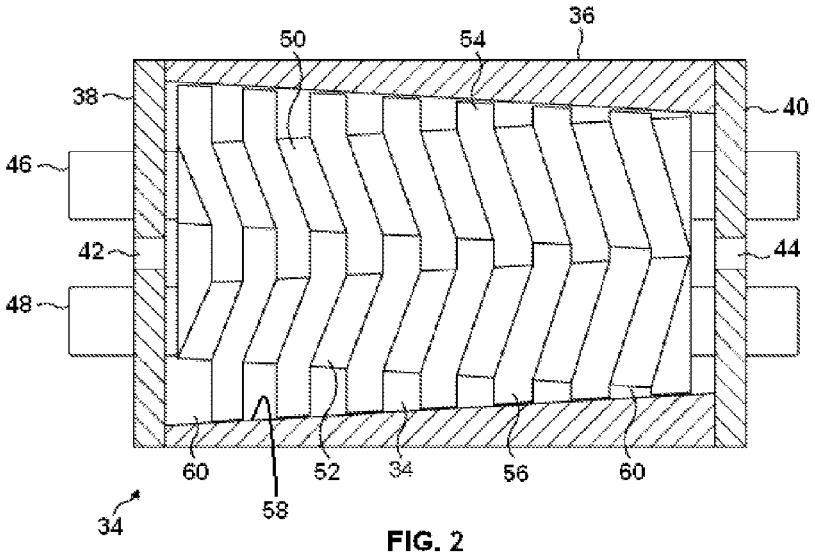
FIG. 2 is a cross section of a screw pump.

With reference to FIG. 2, a screw pump 34 is shown which includes a stator 36 having a top plate 38 and a bottom plate 40. A fluid inlet 42 is formed in the top plate 38, and a fluid outlet 44 is formed in the bottom plate 40. The pump 32 further includes a first shaft 46 and, spaced therefrom and parallel thereto, a second shaft 48 having longitudinal axes substantially orthogonal to the top plate 38 and bottom plate 40. The shafts 46, 48 are adapted for rotation within the stator about their longitudinal axes in a contra-rotational direction.

A first rotor 50 is mounted on the first shaft 46 for rotary movement within the stator 36, and a second rotor 52 is similarly mounted on the second shaft 48. Roots of each of the two rotors have a shape that tapers from the fluid outlet 44 towards the fluid inlet 42, and each rotor has a helical vane or thread 54, 56 respectively formed on the outer surface thereof so that the threads intermesh as illustrated.

The stator 36 defines a pumping, or swept, volume 58 which is tapered towards the outlet 44, and together with the rotors 50, 52 and the threads 54, 56 forms trapped volumes 60 which in use progressively decrease in volume towards the outlet thereby compressing gas between the inlet and outlet.

Figure 3:
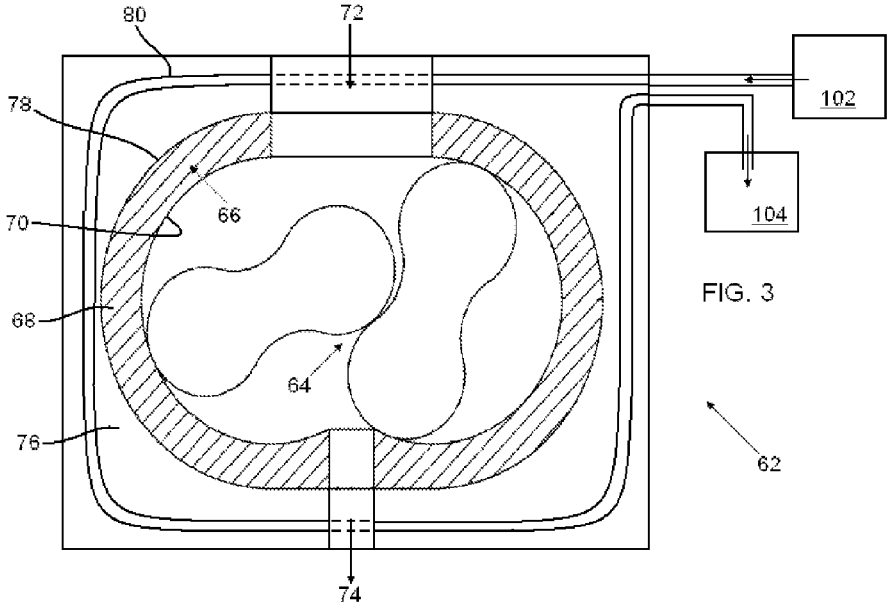
FIG. 3 is a cross section of a Roots pump.

A roots pump 62 in accordance with one embodiment is shown in FIG. 3. Pump 62 comprises a rotor arrangement 64 and a stator arrangement 66, the stator arrangement comprising a first part 68 made from a corrosive resistant material. The first part of the stator arrangement defines the volume 70 which in use is swept by the rotor arrangement for pumping fluid from an inlet 72 to an outlet 74 of the stator arrangement. A second part 76 of the stator arrangement is made from a thermally conductive material which envelopes the first part 68, forming an intimate contact surface 78 therewith, so that heat generated in the first part can be transferred to the second part at the interface surface 78 between the two parts. As shown in FIG. 3, the second part surrounds and is generally co-extensive with the first part at least in the plane of the cross-section shown in FIG. 3 to provide a large surface area at the interface across which heat can be transferred. The first part and the second part form the inlet and the outlet to the swept volume. The second part also preferably surrounds and is generally co-extensive with the axial ends of the first part so that the first part is completely enveloped by the second part. The casting of the second part around the first part provides an intimate contact surface 78 allowing efficient heat transfer. The second part 76 has formed therein at least one duct 80 for conveying a liquid coolant through the second part so that heat can be transferred from the second part to the liquid coolant for cooling the stator arrangement.

A screw pump 82 in accordance with one embodiment is shown in FIG. 4. Pump 82 comprises a rotor arrangement 84 and a stator arrangement 86, the stator arrangement comprising a first part 88 made from a corrosive resistant material. The first part of the stator arrangement defines the volume 90 which in use is swept by the rotor arrangement for pumping fluid from an inlet 92 to an outlet 94 of the stator arrangement. A second part 96 of the stator arrangement is made from a thermally conductive material which envelopes and forms an intimate contact surface 98 with the first part 88, so that heat generated in the first part can be transferred to the second part at the interface surface 98 between the two parts. As shown in FIG. 3, the second part surrounds and is generally co-extensive with the first part at least in the plane of the cross-section shown in FIG. 3 to provide a large surface area at the interface across which heat can be transferred. The first part and the second part form the inlet and the outlet to the swept volume. The second part also preferably surrounds and is generally co-extensive with the axial ends of the first part so that the first part is completely enveloped by the second part. The second part 96 has formed therein at least one duct 100 for conveying a liquid coolant through the second part so that heat can be transferred from the second part to the liquid coolant for cooling the stator arrangement.

In both the embodiments shown in FIGS. 3 and 4, the second part 76, 96 is a casting formed around the first part 68, 88 to provide intimate contact between the first and second parts or stator element parts to improve the transfer, or conduction, of heat from the first part to the second part. The duct, or ducts, 80, 100 is formed in the second part by one or more tubes made from a thermally conductive material which is resistant to corrosion by the cooling liquid to be passed therethrough. The second part is a casting around the tube or tubes to provide intimate contact therebetween to improve the transfer, or conduction, of heat between the second part and the tube or tubes.

The pumps 62, 82 may form part of an open vacuum pumping system comprising a source 102 of cooling liquid and a waste or disposal unit 104 for collecting or disposing of heated liquid coolant that has passed through the ducts. Preferably, the liquid coolant is water as it is plentiful and inexpensive. Recycling of the liquid is not required and therefore unlike known closed systems, a heat exchanger for cooling the liquid is not required.

Figure 6:
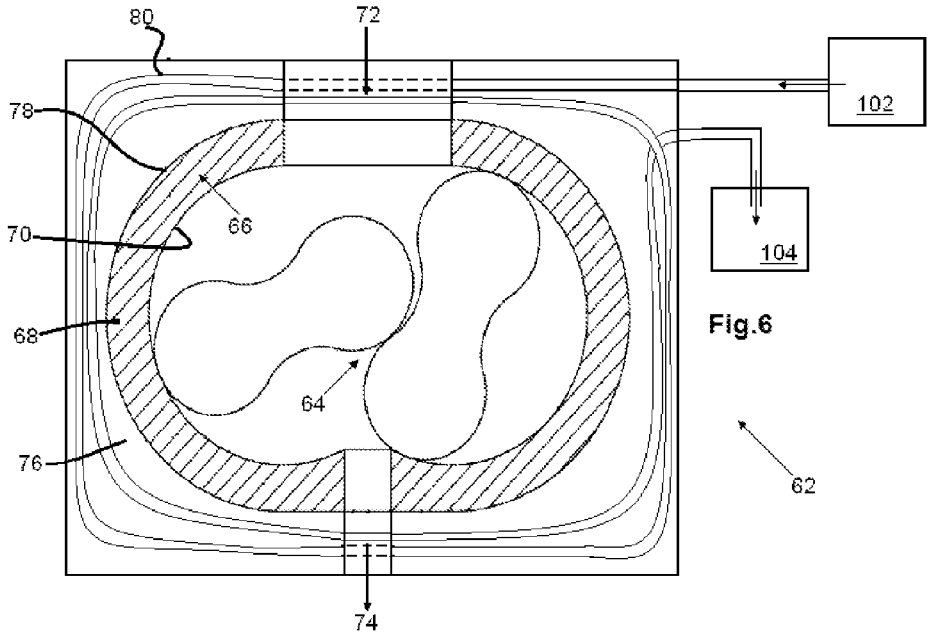
FIG. 6 is a cross section of a Roots pump of a second embodiment.

One duct 80, 100 is shown in FIGS. 3 and 4, which extends through the second part of the stator arrangements and around the first part. The duct may or may not extend fully around the first part although it is preferable that the duct extends a number of times around the first part, forming a plurality of wraps or circuits as shown in the embodiment of FIG. 6, in which elements common to FIG. 3 are numbered similarly. More than one duct may be provided and each duct may form branches where convenient. Preferably, the duct or ducts are located proximate to the interface surface between the first part and the second part so that heat transferred across the interface does not have to be conducted over significant distance prior to being cooled by interaction with coolant in the ducts. More preferably, the ducts generally surround the interface surface so that generally uniform cooling of the first part may occur.

The ducting may preferably be configured to provide even cooling of the stator thereby preventing hot spots and colds spots leading to differential thermal expansion or contraction. It will be noted that cooling plates, particularly when fixed to only one surface of a stator provided differential cooling. It may be further preferably to locate substantial more ducting or at least more surface area for cooling in areas of the stator which are prone to greater temperature elevation during use of the pump.

The first part is preferably made from Spheroidal Graphite (SG) iron, Aus tempered ductile iron or Ni-resist iron, both of which are resistant to corrosion by gases such as Fluorine and other typical gases which are used in vacuum processing of semi-conductor components. The width, or thickness, of the first parts 66, 88, noted as A in FIGS. 3 and 4 respectively, is preferably greater than 1 cm to ensure that the first part, or stator element part is able to withstand the pressures generated within the pump in use.

The second part is preferably made from aluminium, which has a relatively high thermal conductivity. The tube forming the duct or ducts is preferably made from stainless steel, which is selected to resist corrosion by liquid coolant, typically water.

Referring to FIG. 5, a pump 110 is shown which comprises a plurality of pumping stages, 112, 114, 116, 118. Each of the pumping stages comprises a rotor arrangement (not shown) and a stator arrangement 120, 122, 124, 126 for pumping fluid from an inlet to an outlet of each stage. The outlet of one pumping stage is in fluid communication with an inlet of the adjacent downstream stage so that the compression achieved by the pump is cumulative of each of the stages. Inter-stage arrangements 128, 130, 132 interpose adjacent pumping stages. The inter-stage arrangements separate the pumping chambers of adjacent pumping stages and convey fluid from the outlet of an upstream pumping stage to the inlet of a downstream pumping stage. Two head plates 134, 136 are located at each end of the pumping stack. The head plates separate the pumping chambers of the most upstream and most downstream pumping stages, respectively, from other components of the pump, such as gears and motor, and convey fluid into the inlet of the first pumping stage and from the outlet of the final pumping stage. Accordingly, the pump is manufactured from a plurality of discrete layers which are laminated together to form the pump. Lamination may suitably be achieved by one or more anchor rods which pass through apertures in each of the layers and fastened with fasteners such as bolts.

Although not shown in FIG. 5, the stator arrangement of each pumping stage, typically referred to as a stator slice, may be formed with the cast cooling system as described herein. That is, each stator slice comprises a first part formed from a corrosion resistant material, a second part formed from a thermally conductive material. The second part has formed therein at least one duct for conveying a liquid coolant through the second part so that heat can be transferred from the second part to the liquid coolant for cooling the stator slice.

Each of the stator slices in the pump may comprise the inventive cooling arrangement or alternatively one or more but not all of the slices may comprise the cooling arrangement. For example, more heat is generated at higher pressure stages of the pump and therefore, the cooling arrangement may be provided only in one or more of the high pressure stages, for example only in pumping stage 118 in FIG. 5. The laminated arrangement also permits retro-fitting of one or more stator slices having the inventive cooling system into an existing laminated pump.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A vacuum pump comprising a rotor arrangement and a stator arrangement, the stator arrangement comprising a first part made from one of SG iron and Ni-resist iron and having a thickness greater than one centimeter and defining a volume which in use is swept by the rotor arrangement for pumping fluid from an inlet to an outlet of the stator arrangement, and a second part made from aluminium cast over and enveloping the first part so that heat generated in the first part is transferred to the second part at the interface surface between the two parts, the second part cast over at least one tube for conveying a liquid coolant through the second part so that heat is transferred from the second part to the liquid coolant for cooling the stator arrangement.

2. The vacuum pump as claimed in claim 1, wherein said at least one tube is made from a thermally conductive material which is resistant to corrosion by the liquid.

3. The vacuum pump as claimed claim 1, wherein the tube is made from stainless steel.

4. The vacuum pump of claim 1, wherein the pump is connected to a source of liquid coolant that conveys liquid coolant to the stator arrangement for cooling and wherein the pump is connected to a liquid waste unit that disposes of liquid coolant which has been conveyed through the stator arrangement.

5. A vacuum pump stator arrangement comprising a first part made from a corrosive resistant material having a thickness greater than one centimeter and defining a volume which in use is swept by a rotor arrangement for pumping fluid from an inlet to an outlet of the stator arrangement, and a second part made from a thermally conductive material which envelopes the first part so that heat generated in the first part is transferred to the second part at the interface surface between the two parts, the second part having formed therein at least one duct for conveying a liquid coolant through the second part so that heat is transferred from the second part to the liquid coolant for cooling the stator.

6. The vacuum pump stator arrangement as claimed in claim 5, comprising a plurality of stator slices forming a laminated pump structure, at least one of said stator slices comprising a first part made from a corrosive resistant material defining a volume which in use is swept by a rotor arrangement for pumping fluid from an inlet to an outlet of the stator arrangement, and a second part made from a thermally conductive material which envelopes the first part so that heat generated in the first part is transferred to the second part at the interface surface between the two parts, the second part having formed therein at least one duct for conveying a liquid coolant through the second part so that heat is transferred from the second part to the liquid coolant for cooling the stator arrangement.

7. A method of manufacturing a stator slice for a stator arrangement comprising steps of:

forming a first stator element part made from a corrosive resistant material comprising an inlet and outlet, having a thickness greater than one centimeter and defining a volume which, in use, is swept by a rotor arrangement for pumping fluid from an inlet to an outlet of the stator element;

casting a second stator element part, made from a thermally conductive material, around said first stator element part to envelope the first stator element part and form an intimate interface surface between the first and second stator element parts so that, in use, heat generated in the first stator element part is transferred to the second stator element part at the interface surface between the two stator element parts; and forming at least one duct in the second stator element part for conveying a liquid coolant through the second stator element part so that, in use, heat is transferred from the second stator element part to the liquid coolant for cooling the stator arrangement.

* * * * *